US009415404B2

(12) United States Patent
Toh et al.

(10) Patent No.: US 9,415,404 B2
(45) **Date of Patent: *Aug. 16, 2016**

(54) HIGH VISCOSITY FLUID DISPENSING SYSTEM

(71) Applicant: The Boeing Company, Chicago, IL (US)

(72) Inventors: Chin H. Toh, Orange, CA (US); Trent Rob Logan, Foothill Ranch, CA (US)

(73) Assignee: THE BOEING COMPANY, Chicago, IL (US)

( * ) Notice: Subject to any disclaimer, the term of this patent is extended or adjusted under 35 U.S.C. 154(b) by 537 days.

This patent is subject to a terminal disclaimer.

(21) Appl. No.: 13/919,318

(22) Filed: Jun. 17, 2013

(65) Prior Publication Data

US 2014/0367480 A1 Dec. 18, 2014

(51) Int. Cl.

| | |
|---|---|
| ***B05B 1/14*** | (2006.01) |
| ***B05B 1/24*** | (2006.01) |
| ***B05B 1/28*** | (2006.01) |
| ***B05B 9/08*** | (2006.01) |
| ***B05B 15/00*** | (2006.01) |
| ***B05B 9/00*** | (2006.01) |

(52) U.S. Cl.

CPC ... *B05B 1/14* (2013.01); *B05B 1/24* (2013.01); *B05B 1/28* (2013.01); *B05B 9/002* (2013.01); *B05B 9/0811* (2013.01); *B05B 9/0838* (2013.01); *B05B 15/00* (2013.01)

(58) Field of Classification Search

CPC ..... B05B 1/14; B05B 1/28; B05B 9/002; B05B 9/0811; B05B 9/0838; B05B 15/00; B05B 1/24; B65B 39/00; B65B 2039/008; B65B 2039/009; B67D 7/42; B67D 7/54

See application file for complete search history.

(56) References Cited

U.S. PATENT DOCUMENTS

| | | | | |
|---|---|---|---|---|
| 3,883,305 | A * | 5/1975 | Hoskins | G01N 35/021 141/130 |
| 3,938,467 | A | 2/1976 | Radowicz | |
| 5,094,278 | A * | 3/1992 | Arao | B65B 39/00 141/116 |
| 5,335,862 | A * | 8/1994 | Esper | B65B 39/00 141/115 |

(Continued)

FOREIGN PATENT DOCUMENTS

| | | | | |
|---|---|---|---|---|
| DE | 4225618 | A1 | 2/1994 | |
| EP | 0509323 | A2 | 10/1992 | |
| EP | 0572061 | A1 | 12/1993 | |
| JP | EP 0278560 | A1 * | 8/1988 | B65B 39/00 |

OTHER PUBLICATIONS

International Search Report and Written Opinion, dated Jan. 28, 2015, regarding Application No. PCT/US2014/038219, 13 pages.

(Continued)

*Primary Examiner* — Darren W Gorman
(74) *Attorney, Agent, or Firm* — Yee & Associates, P.C.

(57) ABSTRACT

A method and apparatus for dispensing a fluid. In one illustrative embodiment, an apparatus may comprise a housing comprising a chamber, a dispensing device, and a nozzle system. The housing may be configured to receive the fluid. The housing may be configured to increase a tendency of the fluid to flow within the chamber. The dispensing device may be configured to move the fluid in the chamber towards an exit of the chamber such that the fluid is dispensed through the exit of the chamber. The nozzle system may be configured to control an exit pressure of the fluid that is dispensed through the nozzle system.

31 Claims, 11 Drawing Sheets

(56) References Cited

U.S. PATENT DOCUMENTS

| | | | | |
|---|---|---|---|---|
| 5,472,144 | A | 12/1995 | McDonald | |
| 5,865,221 | A | 2/1999 | Ludwig et al. | |
| 7,594,616 | B2 * | 9/2009 | Hupp | F16K 23/00 141/311 A |
| 2014/0077006 | A1 * | 3/2014 | Goudy | B05B 1/14 239/565 |
| 2014/0367481 | A1 | 12/2014 | Toh et al. | |

OTHER PUBLICATIONS

"See-Flo IPD Dispenses High Viscosity Adhesives," Sealant Equipment and Engineering, Inc., Apr. 2000, 2 pages, accessed Mar. 26, 2013. http://www.sealantequipment.com/pressrel/seefloipd.htm.

"Non-stick surface," Wikipedia Foundation, Inc., last modified Mar. 2013, 3 pages, accessed Mar. 26, 2013. http://en.wikipedia.org/wiki/Non-stick_surface.

"Polytetrafluoroethylene," Wikipedia Foundation, Inc., last modified Mar. 2013, 10 pages, accessed Mar. 26, 2013. http://en.wikipedia.org/wiki/Polytetrafluoroethylene.

"Universal Summit Nozzles," Nordson Corporation, Oct. 2011, 2 pages, accessed Mar. 26, 2013. http://www.nordson.com/en-us/divisions/adhesive-dispensing/Literature/NWL/NWL5709.pdf.

Office Action, dated Sep. 18, 2015, regarding U.S. Appl. No. 14/096,275, 22 pages.

Final Office Action, dated Mar. 24, 2016, regarding U.S. Appl. No. 14/096,275, 12 pages.

* cited by examiner

1100

1102
SPECIFICATION AND DESIGN
1104
MATERIAL PROCUREMENT
1106
COMPONENT AND SUBASSEMBLY MANUFACTURING
1108
SYSTEM INTEGRATION
1110
CERTIFICATION AND DELIVERY
1112
IN SERVICE
1114
MAINTENANCE AND SERVICE

1200

AIRCRAFT
1202
AIRFRAME
INTERIOR
1206
SYSTEMS
PROPULSION SYSTEM
ELECTRICAL SYSTEM
1208
1212
1210
1214
1204
HYDRAULIC SYSTEM
ENVIRONMENTAL SYSTEM

HIGH VISCOSITY FLUID DISPENSING SYSTEM

BACKGROUND INFORMATION

1. Field:

The present disclosure relates generally to dispensing fluids and, in particular, to dispensing high viscosity fluids. Still more particularly, the present disclosure relates to a method and apparatus for dispensing a high viscosity fluid, such as sealant, onto a surface from a desired distance away from the surface in a desired spray pattern.

2. Background:

Assembly operations oftentimes require applying sealant to various locations. For example, without limitation, during the assembly of an aircraft, sealant may be applied to joints and fastener elements to seal faying surfaces, protect components, prevent leakages, and/or reduce undesired electromagnetic effects. As one illustrative example, sealant may be applied over a fastener element installed at an outer surface of an object to prevent any fluid from escaping the object and/or entering the object.

Oftentimes, sealant may be manually dispensed from a sealant cartridge and applied. However, the manual dispensing and application of the sealant may be more time-consuming and/or difficult than desired. In some cases, a sealant cartridge may be mounted onto a robot that is used to dispense the sealant from the sealant cartridge. However, these different processes may require more frequent replacements of sealant cartridges than desired. Further, these types of processes may require more cleanup of spills and/or excess sealant.

Additionally, some currently available methods for dispensing sealant may be unable to dispense sealant in a desired pattern at desired distances. In particular, the accuracy of the pattern formed by the sealant dispensed from these currently available methods for dispensing sealant may decrease as the distance between the sealant dispensing system and the surface onto which the sealant is being applied increases.

Working with sealant using some currently available methods for dispensing sealant may be more difficult than desired, depending on the viscosity of the sealant. Typically, sealants having viscosities above, for example, without limitation, about 10,0000 centiPoise (cP), may be more difficult to dispense in a desired pattern with a desired level of accuracy than desired. Therefore, it would be desirable to have a method and apparatus that takes into account at least some of the issues discussed above, as well as other possible issues.

SUMMARY

In one illustrative embodiment, an apparatus may comprise a housing comprising a chamber, a dispensing device, and a nozzle system. The housing may be configured to receive a fluid. The housing may be configured to increase a tendency of the fluid to flow within the chamber. The dispensing device may be configured to move the fluid in the chamber towards an exit of the chamber such that the fluid is dispensed through the exit of the chamber. The nozzle system may be configured to control an exit pressure of the fluid that is dispensed through the nozzle system.

In another illustrative embodiment, a fluid dispensing system may comprise a housing, a dispensing system, a nozzle system, a fluid transfer system, a tool system associated with the housing, an air protection device associated with the tool system, an attachment feature, and a controller. The housing may comprise an outer surface, an inner surface, and a heating system. The inner surface may be configured to form a chamber. The inner surface may be comprised of a friction-reducing material selected from one of polytetrafluoroethylene, a nanostructured non-stick material, and a nanostructured ceramic material. The friction-reducing material may be configured to reduce friction generated between the fluid and the inner surface such that a tendency of the fluid to flow through the chamber is increased. The heating system may be configured to heat the fluid within the chamber to reduce a viscosity of the fluid in the chamber such that the tendency of the fluid to flow through the chamber is increased. The heating system may comprise a plurality of heating coils located between the inner surface of the housing and the outer surface of the housing. The dispensing device may be configured to move the fluid in the chamber towards an exit of the chamber such that the fluid is dispensed through the exit of the chamber. The fluid dispensing system may comprise a piston configured to move within the chamber and a plurality of stoppers. At least one of the plurality of stoppers may be configured to limit movement of the piston within the chamber. The nozzle system may comprise a nozzle and a nozzle screen positioned at the exit of the chamber. The nozzle screen may comprise a plurality of holes having a plurality of sizes selected to control an exit pressure of the fluid across the nozzle screen as the fluid exits the nozzle screen such that the fluid is dispensed towards a surface in a desired spray pattern with a desired velocity. Each of the plurality of holes may have a tapered shape. The fluid transfer system may be configured to transfer the fluid from a fluid source to the chamber. The tool system may be configured to hold a number of tools for use in performing fluid dispensing operations. The air protection device may be configured to shield the number of tools from fluid spatter. The attachment feature may be configured for association with the housing. The attachment feature may be further configured for use in attaching one of a drip tray and a drip bucket to the housing to catch any dripping of the fluid as the fluid exits the chamber. The controller may be configured to control the heating system and the dispensing device.

In yet another illustrative embodiment, a method for dispensing a fluid may be provided. The fluid may be received within a chamber formed by an inner surface of a housing. A tendency of the fluid to flow through the chamber may be increased. The fluid may be moved through the chamber towards an exit of the chamber using a dispensing device such that the fluid is dispensed through a nozzle system at the exit of the chamber. An exit pressure of the fluid that is dispensed through the nozzle system may be controlled.

In still yet another illustrative embodiment, a method for dispensing a fluid is provided. The fluid from a fluid source may be transferred to a chamber using a fluid transfer system. The fluid within the chamber may be received. The chamber may be formed by an inner surface of a housing. The inner surface may be comprised of a friction-reducing material selected from one of polytetrafluoroethylene, a nanostructured non-stick material, and a nanostructured ceramic material. Friction generated between the fluid and the inner surface of the chamber as the fluid moves through the chamber may be reduced by the friction-reducing material such that a tendency of the fluid to flow through the chamber is increased. The fluid may be heated within the chamber using a heating system comprising a plurality of heating coils located between the inner surface of the housing and an outer surface of the housing to reduce a viscosity of the fluid in the chamber such that tendency of the fluid to flow through the chamber is increased. The fluid in the chamber may be moved towards an exit of the chamber using a dispensing device such that the fluid is dispensed through a nozzle screen positioned at the exit of the chamber. The fluid may be dispensed through a plurality of holes in the nozzle screen towards a surface. An exit pressure of the fluid across the nozzle screen may be controlled as the fluid is dispensed through the plurality of holes in the nozzle screen. The plurality of holes may have a plurality of sizes selected such that the fluid exits the nozzle screen towards the surface in a desired spray pattern with a desired velocity. A number of tools housed in a tool housing associated with the housing for use in performing fluid dispensing operations using an air protection device may be shielded.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

The illustrative embodiments recognize and take into account different considerations. For example, the illustrative embodiments recognize and take into account that it may be desirable to have a method and apparatus for dispensing sealant that allows the viscosity of the fluid to be controlled such that the mobility of the sealant may be increased. In this manner, the sealant may be dispensed more easily. Further, the illustrative embodiments recognize and take into account that it may be desirable to have an apparatus that allows the sealant to be pressurized as the sealant is dispensed such that the sealant may be dispensed in a desired pattern with a desired velocity from a desired distance.

Thus, the illustrative embodiments provide a method and apparatus for applying a fluid having a high viscosity onto a surface. In one illustrative embodiment, an apparatus may comprise a housing, a heating system, and a dispensing device. The housing may comprise a chamber configured to receive a fluid. The chamber may have an inner surface comprised of a friction-reducing material. The heating system may be configured to heat the fluid within the chamber to reduce viscosity of the fluid in the chamber to increase a mobility of the fluid within the chamber. The dispensing device may be configured to move the fluid in the chamber towards an exit of the chamber such that the fluid may be dispensed through the exit of the chamber.

Figure 1:
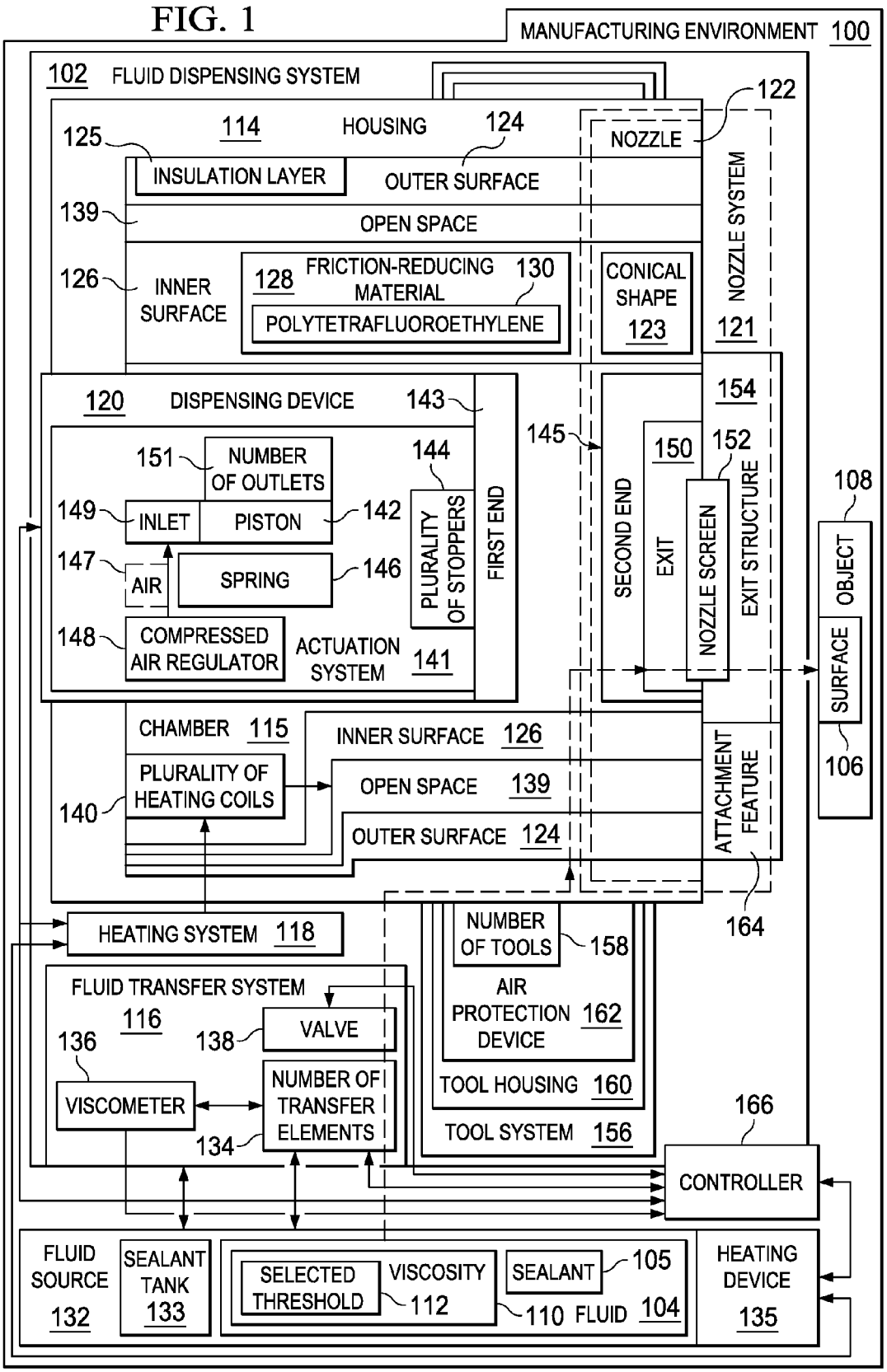
FIG. 1 is an illustration of a manufacturing environment in the form of a block diagram in accordance with an illustrative embodiment.

Referring now to the figures and, in particular, with reference to FIG. 1, an illustration of a manufacturing environment is depicted in the form of a block diagram in accordance with an illustrative embodiment. In this illustrative example, manufacturing environment 100 may be an example of an environment in which manufacturing operations may be performed. These manufacturing operations may include, for example, without limitation, fluid dispensing operations.

Within manufacturing environment 100, fluid dispensing system 102 may be used to dispense fluid 104 onto surface 106 of object 108. Object 108 may take a number of different forms. Depending on the implementation, object 108 may be comprised of one or more components. For example, without limitation, object 108 may take the form of a fuselage, a wing, a spar, a fastener element, a panel, a door, a joint, a hinged object, a box, a vehicle, a desk, a chair, a flap, an aileron, a ship, a spacecraft, or some other type of object.

Fluid 104 may take the form of sealant 105 in this illustrative example. Further, fluid 104 may have viscosity 110. In this illustrative example, viscosity 110 may be high. In particular, viscosity 110 may be above selected threshold 112 when fluid 104 is at a baseline temperature. This baseline temperature may be, for example, room temperature, ambient temperature, or some other reference temperature.

Selected threshold 112 may be, for example, without limitation, about 10,000 centiPoise (cP). In other cases, selected threshold 112 may be about 25,000 centiPoise or 100,000 centiPoise. In yet other examples, selected threshold 112 may be about 500,000 centiPoise.

As depicted, fluid dispensing system 102 may include housing 114, fluid transfer system 116, heating system 118, dispensing device 120, and nozzle system 121. Housing 114 may have outer surface 124 and inner surface 126. Inner surface 126 of housing 114 may form chamber 115 configured to hold fluid 104. Nozzle system 121 may be used to dispense fluid 104.

Chamber 115 may extend through both housing 114 and nozzle 122 in nozzle system 121. In one illustrative example, nozzle 122 may be a separate component attached to housing 114. In other illustrative examples, nozzle 122 may be formed by a portion of housing 114. Nozzle 122 may be the component through which fluid 104 is dispensed and applied to surface 106. Nozzle 122 may have conical shape 123 configured to increase the velocity with which fluid 104 is dispensed. In particular, conical shape 123 of nozzle 122 may allow fluid 104 to converge and pick up velocity as fluid 104 flows out of nozzle 122.

In this illustrative example, inner surface 126 of housing 114 may be the portion of housing 114 that contacts fluid 104 while fluid 104 is within chamber 115. Inner surface 126 may be comprised of friction-reducing material 128. Friction-reducing material 128 may be selected such that friction between fluid 104 and inner surface 126 is reduced when fluid 104 is moving, or flowing, within chamber 115.

In one illustrative example, friction-reducing material 128 may comprise polytetrafluoroethylene (PTFE) 130. Of course, in other illustrative example, friction-reducing material 128 may be comprised of a nanostructured ceramic material, a nanostructured non-stick material, or some other type of material.

As depicted, fluid transfer system 116 may transfer fluid 104 from fluid source 132 into chamber 115. Fluid source 132 may be configured to store and hold fluid 104. When fluid 104 takes the form of sealant 105, fluid source 132 may take the form of sealant tank 133.

In this illustrative example, heating device 135 may be associated with fluid source 132. Heating device 135 may be used to heat fluid 104 held within fluid source 132. In particular, fluid 104 may be heated to a temperature based on viscosity 110.

For example, without limitation, viscosity 110 of fluid 104 may be at a level that reduces the mobility of fluid 104. As used herein, the "mobility" of fluid 104 may mean the tendency of fluid 104 to flow. As viscosity 110 of fluid 104 increases, the mobility of fluid 104 may decrease. Heating device 135 may be used to heat fluid 104 to reduce viscosity 110 of fluid 104 and thereby, increase the mobility of fluid 104. In other words, the tendency of fluid 104 to flow through chamber 115 may be increased using heating device 135.

In one illustrative example, heating device 135 may be considered a part of heating system 118. In other illustrative examples, heating device 135 may be considered separate from heating system 118. Heating device 135 may take a number of different forms. For example, without limitation, heating device 135 may take the form of a plurality of heating coils, a microwave oven, or some other type of heating device.

Fluid transfer system 116 may include at least one of number of transfer elements 134, viscometer 136, or valve 138. As used herein, the phrase "at least one of," when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required.

For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Further, as used herein, a "number of" items may be one or more items. In this manner, number of transfer elements 134 may include one or more transfer elements. A transfer element in number of transfer elements 134 may take the form of a hose, a tube, a coil, a hollow elongate member, or some other type of element configured to allow fluid 104 to flow. Number of transfer elements 134 may be used to transfer fluid 104 from fluid source 132 into chamber 115.

Valve 138 may be used to control the flow of fluid 104 into chamber 115. In this manner, valve 138 may also be referred to as a flow control valve. Viscometer 136 may be used to measure viscosity 110 of fluid 104 as fluid 104 leaves fluid source 132 and is transferred into chamber 115. Heating system 118 may be used to ensure that a desired viscosity for fluid 104 is maintained within chamber 115.

In one illustrative example, heating system 118 may take the form of plurality of heating coils 140. Plurality of heating coils 140 may be used to heat fluid 104 within chamber 115 to ensure that viscosity 110 of fluid 104 is at the desired level to ensure the desired mobility of fluid 104 within chamber 115.

Plurality of heating coils 140 may be located within open space 139 between outer surface 124 and inner surface 126 of housing 114 in this example. Outer surface 124 may protect plurality of heating coils 140 from exposure to environmental elements and/or protect an operator from contacting plurality of heating coils 140. Outer surface 124 may also have insulation layer 125 wrapped along the length of outer surface 124 to shield the operator from contacting outer surface 124 that has been heated and to help maintain the temperature of fluid 104. Inner surface 126 separates plurality of heating coils 140 from fluid 104 such that the heating of fluid 104 may be performed in a more controlled manner.

In this illustrative example, dispensing device 120 may be used to move fluid 104 through chamber 115 and out of chamber 115. As depicted, dispensing device 120 may include actuation system 141. Actuation system 141 may be located at or near first end 143 of chamber 115. Actuation system 141 may be configured to move fluid 104 from first end 143 of chamber 115 towards second end 145 of chamber 115.

Actuation system 141 may include, for example, without limitation, any number of actuators and/or other devices. In one illustrative example, actuation system 141 may include piston 142, plurality of stoppers 144, spring 146, and compressed air regulator 148.

Piston 142 may be configured to move fluid 104 towards second end 145 of chamber 115. Piston 142 may be moved using compressed air generated by compressed air regulator 148. Compressed air regulator 148 may be configured to pump air 147 that is compressed into inlet 149 associated with piston 142. Air 147 may be compressed according to desired specifications. This compressed air may power piston 142 and cause piston 142 to move in a direction towards second end 145. As piston 142 moves towards second end 145, air 147 may be discharged through number of outlets 151 associated with piston 142. Number of outlets 151 may allow air 147 to exit housing 114.

As used herein, when one component is "associated" with another component, the association is a physical association in the depicted examples. For example, a first component, such as inlet 149, may be considered to be associated with a second component, such as piston 142, by being secured to the second component, bonded to the second component, mounted to the second component, welded to the second component, fastened to the second component, and/or connected to the second component in some other suitable manner. The first component also may be connected to the second component using a third component. Further, the first component may be considered to be associated with the second component by being formed as part of and/or as an extension of the second component.

Once air 147 has been discharged through number of outlets 151, spring 146 may be used to allow piston 142 to move back towards first end 143. In other words, spring 146 may allow piston 142 to return to the starting position of piston 142.

Plurality of stoppers 144 may be used to stop the movement of piston 142. In one illustrative, plurality of stoppers 144 may include one stopper to limit the movement of piston 142 in the direction towards second end 145 and another stopper to limit the movement of piston 142 in the direction towards first end 143.

In this illustrative example, the movement of piston 142 in the direction towards second end 145 may move fluid 104 towards exit 150 of chamber 115 at second end 145 of chamber 115 within nozzle 122. In this manner, exit 150 of chamber 115 may also be the exit of nozzle 122. In particular, fluid 104 may be moved such that fluid 104 is dispensed through exit 150 of chamber 115.

Nozzle system 121 may also include nozzle screen 152. As depicted, nozzle screen 152 may be positioned at exit 150 of chamber 115. Nozzle screen 152 may be used to modify the flow of fluid 104 out of chamber 115 at exit 150. Nozzle screen 152 may be associated with nozzle 122. In this manner, nozzle screen 152 may be considered part of nozzle 122, attached to nozzle 122, or associated with nozzle 122 in some other manner. Nozzle screen 152 may be used to increase the exit pressure of fluid 104 dispensed out of nozzle 122 such that fluid 104 is dispensed in a spraying manner.

In some illustrative examples, nozzle 122 may be used to increase the exit pressure of fluid 104 dispensed out of nozzle 122, while nozzle screen 152 may be used to screen, or filter, fluid 104 being dispensed through nozzle screen 152. For example, without limitation, nozzle screen 152 may be used to filter out any lumps in fluid 104 such that fluid 104 dispensed through nozzle screen 152 has a desired consistency. In this manner, nozzle 122 and/or nozzle screen 152 may be used to control the exit pressure of fluid 104 being dispensed through nozzle system 121.

In this illustrative example, exit structure 154 may also be associated with nozzle 122. Exit structure 154 may also be positioned at second end 145 of chamber 115 at exit 150. Exit structure 154 may be used to further control the flow of fluid 104 out of nozzle 122. In one illustrative example, exit structure 154 may take the form of a conical rim. In some cases, the size and/or shape of exit structure 154 may be adjustable such that the flow of fluid 104 out of nozzle 122 may be adjusted as needed.

Additionally, fluid dispensing system 102 may also include tool system 156. Tool system 156 may include number of tools 158 and tool housing 160. Number of tools 158 may be housed within tool housing 160. Number of tools 158 may be configured for use in performing fluid dispensing operations.

For example, without limitation, number of tools 158 may include at least one of an imaging device, a light source, a number of sensor devices, or some other type of device. The imaging device may be used to monitor the fluid dispensing operations and assist in the positioning of fluid dispensing system 102. The light source may be needed for dispensing fluid 104 in areas of low visibility and/or in enclosed spaces. The sensor devices may be used for measuring the thickness of fluid 104 being dispensed for quality control purposes. In this manner, any number of devices may be included within tool system 156 for use in performing fluid dispensing operations.

In this illustrative example, air protection device 162 may be associated with tool housing 160. At least one of number of tools 158 may be exposed to the environment around fluid dispensing system 102 within tool housing 160. Tool housing 160 may need to be at least partially open such that number of tools 158 may have a line of sight towards fluid 104 being dispensed through nozzle 122 and/or surface 106.

Air protection device 162 may be configured to create a curtain of air that shields number of tools 158 from fluid spatter and/or the environment around fluid dispensing system 102. This curtain of air still allows number of tools 158 to maintain visibility of fluid 104 being dispensed and/or surface 106 as needed.

In one illustrative example, fluid dispensing system 102 may also have attachment feature 164. In particular, attachment feature 164 may be configured for association with housing 114. Further, attachment feature 164 may be configured for use in attaching one of a drip tray (not shown), a drip bucket (not shown), or some other type of object (not shown) that can catch any dripping of fluid 104 as fluid 104 is dispensed through nozzle 122. In one illustrative example, attachment feature 164 may take the form of a hook, a fastener element, or some other type of attachment feature.

As depicted, controller 166 may be used to control at least one of heating system 118, actuation system 141, valve 138, or some other component within fluid dispensing system 102. In particular, controller 166 may be configured to control compressed air regulator 148 within actuation system 141. Controller 166 may be considered part of or separate from fluid dispensing system 102, depending on the implementation.

In some cases, controller 166 may be configured to receive data from viscometer 136. Controller 166 may use this data to control heating system 118, heating device 135, and/or valve 138. In particular, controller 166 may control the temperature to which heating system 118 is used to heat fluid 104 within chamber 115 and/or the temperature to which heating device 135 is used to heat fluid 104 within fluid source 132 based on viscosity 110 of fluid 104 as measured by viscometer 136.

In this manner, fluid dispensing system 102 may allow fluid 104 having viscosity 110 above selected threshold 112 to be dispensed with ease. Viscosity 110 of fluid 104, and thus the mobility of fluid 104, may be controlled using heating system 118 and heating device 135. Further, the friction generated between fluid 104 and inner surface 126 of chamber 115 may be reduced by friction-reducing material 128. Thus, the dispensing of fluid 104 may be made easier.

Figure 2:
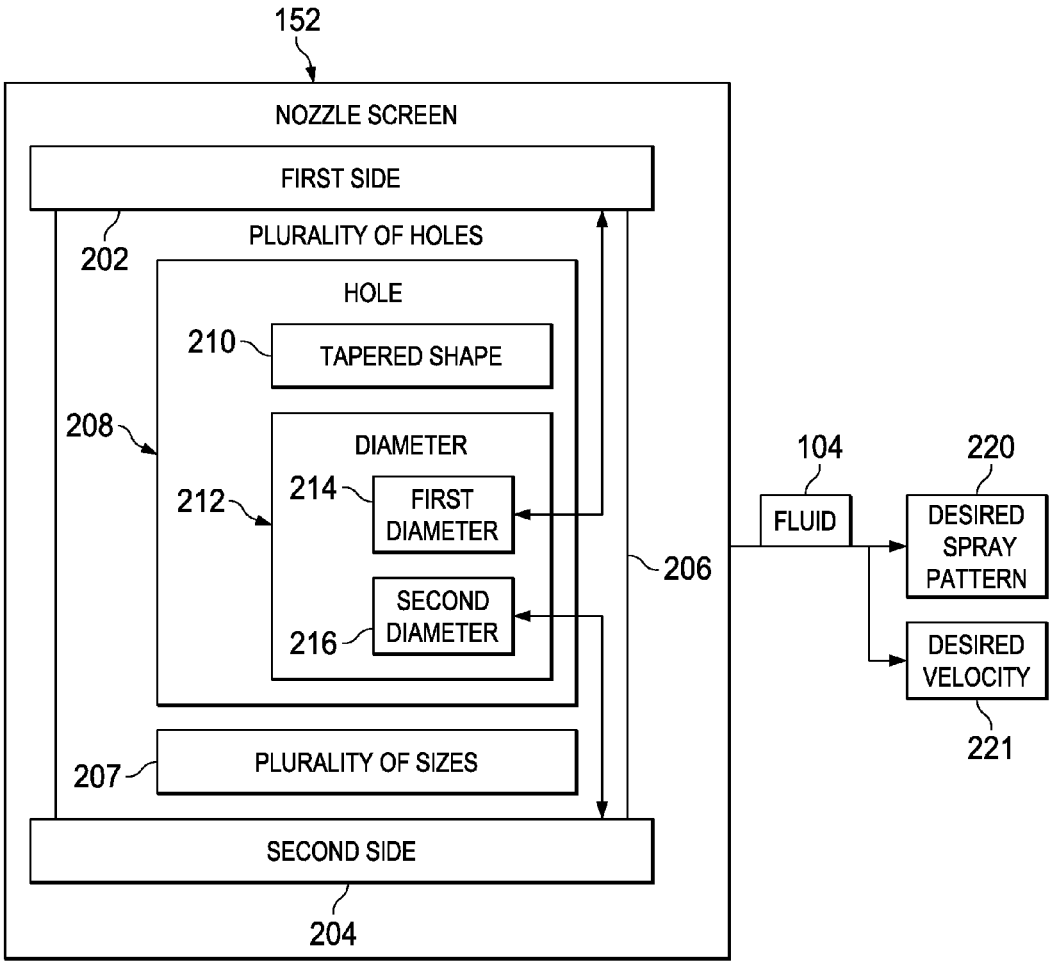
FIG. 2 is an illustration of a nozzle screen in the form of a block diagram in accordance with an illustrative embodiment.

With reference now to FIG. 2, an illustration of nozzle screen 152 from FIG. 1 is depicted in greater detail in the form of a block diagram in accordance with an illustrative embodiment. In this illustrative example, nozzle screen 152 may have first side 202 and second side 204.

First side 202 may be configured to face exit 150 in FIG. 1. Second side 204 may be configured to face away from exit 150 and nozzle 122. In particular, second side 204 may be configured to face surface 106 in FIG. 1 when fluid dispensing system 102 in FIG. 1 is positioned relative to surface 106. In this manner, fluid 104 may enter nozzle screen 152 through first side 202 and exit nozzle screen 152 through second side 204.

Further, nozzle screen 152 may have plurality of holes 206 configured to extend from first side 202 to second side 204. In particular, each of plurality of holes 206 may form a channel through nozzle screen 152 that is open at both first side 202 and second side 204.

Plurality of holes 206 may have plurality of sizes 207. Some of plurality of holes 206 may have one size, while other holes in plurality of holes 206 may have different sizes.

Hole 208 may be an example of one of plurality of holes 206. As depicted, hole 208 may have tapered shape 210. With tapered shape 210, diameter 212 of hole 208 changes. In particular, diameter 212 of hole 208 may be first diameter 214 at first side 202 and second diameter 216 at second side 204. First diameter 214 may be greater than second diameter 216 in this illustrative example.

The tapered shape of each of plurality of holes 206 may be sized such that the exit pressure of fluid 104 from FIG. 1 dispensed through nozzle screen 152 may be increased as fluid 104 passes through nozzle screen 152. In some cases, plurality of holes 206 may be considered a plurality of small nozzles working in parallel such that fluid 104 is "sprayed out" through nozzle screen 152 in a plurality of streams as compared to a single stream. This type of configuration for nozzle screen 152 may allow fluid 104 to be sprayed out in a controlled manner from a greater distance from surface 106 in FIG. 1 as compared to when each of plurality of holes 206 has a substantially constant diameter between first side 202 and second side 204 of nozzle screen 152.

Nozzle screen 152 may take a number of different shapes, depending on the implementation. For example, without limitation, nozzle screen 152 may have a circular shape, a square shape, a rectangular shape, a triangular shape, an elliptical shape, an octagonal shape, or some other type of shape. The shape of nozzle screen 152 and the arrangement of plurality of holes 206 may be selected such that fluid 104 sprays out of nozzle screen 152 in desired spray pattern 220 with desired velocity 221.

Further, the cross-sectional shape of each of plurality of holes 206 may be selected such that fluid 104 is sprayed out in desired spray pattern 220 with desired velocity 221. For example, without limitation, the cross-sectional shape of hole 208 may be selected from one of a circular shape, a square shape, a rectangular shape, a triangular shape, an elliptical shape, an octagonal shape, or some other type of shape. Spraying fluid 104 with desired velocity 221 may ensure that fluid 104 reaches surface 106 from a selected distance away from surface 106.

Additionally, in this illustrative example, nozzle screen 152 may be comprised of friction-reducing material 128. In particular, first side 202, second side 204, and the inner surfaces of plurality of holes 206 may be comprised of friction-reducing material 128 such that all portions of nozzle screen 152 that may come into contact with fluid 104 may be comprised of friction-reducing material 128. In this manner, friction between fluid 104 and nozzle screen 152 may be reduced as fluid 104 passes through nozzle screen 152.

The illustrations of manufacturing environment 100, and in particular, fluid dispensing system 102 in FIG. 1 and nozzle screen 152 in FIG. 2 are not meant to imply physical or architectural limitations to the manner in which an illustrative embodiment may be implemented. Other components in addition to or in place of the ones illustrated may be used. Some components may be optional. Also, the blocks are presented to illustrate some functional components. One or more of these blocks may be combined, divided, or combined and divided into different blocks when implemented in an illustrative embodiment.

Although actuation system 141 is described as comprising piston 142, spring 146, and compressed air regulator 148, actuation system 141 may be implemented in some other manner. For example, without limitation, actuation system 141 may be implemented using a motor-driven roller screw, an electromagnetic slider, and/or other types of devices.

In other illustrative examples, attachment feature 164 may be optional. In some cases, tool system 156 may be optional.

Figure 3:
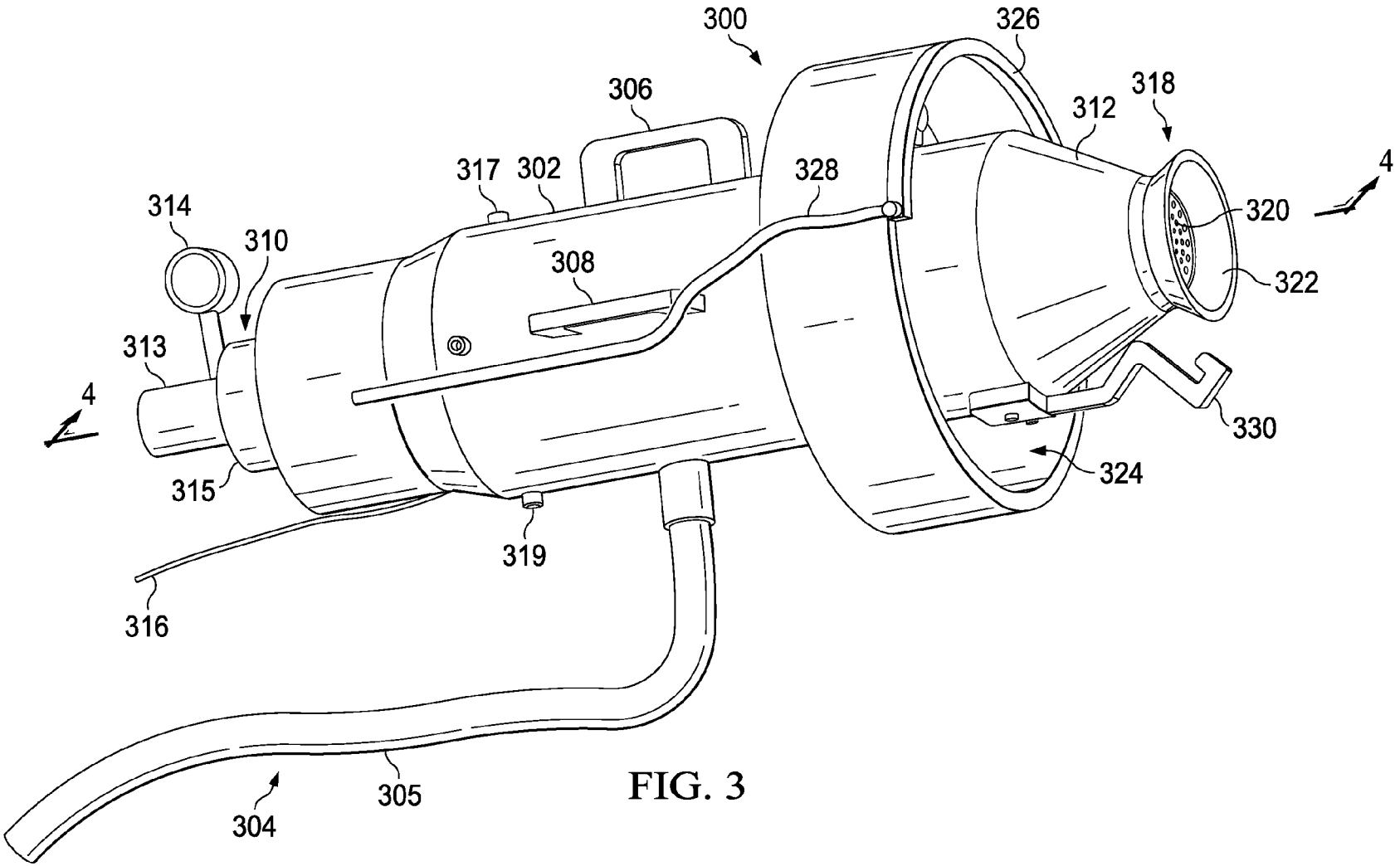
FIG. 3 is an illustration of a fluid dispensing system in accordance with an illustrative embodiment.

With reference now to FIG. 3, an illustration of a fluid dispensing system is depicted in accordance with an illustrative embodiment. In this illustrative example, fluid dispensing system 300 may be an example of one implementation for fluid dispensing system 102 in FIG. 1. As depicted, fluid dispensing system 300 may include housing 302, fluid transfer system 304, handle 306, handle 308, and actuation system 310.

Housing 302, fluid transfer system 304, and actuation system 310 may be examples of implementations for housing 114, fluid transfer system 116, and actuation system 141, respectively, in FIG. 1. Housing 302 may include nozzle 312 in this example. Nozzle 312 may be an example of one implementation for nozzle 122 in FIG. 1. Handle 306 and handle 308 may be used by an operator to handle and operate fluid dispensing system 300.

As depicted, fluid transfer system 116 may include hose 305 and other components (not shown in this view). Hose 305 may be an example of one implementation for a transfer element in number of transfer elements 134 in FIG. 1. Hose 305 may be used to transfer fluid (not shown) from a fluid source (not shown) into a chamber (not shown) within housing 302.

Actuation system 310 may include inlet 313, compressed air regulator 314, and piston 315. Inlet 313, compressed air regulator 314, and piston 315 may be examples of implementations for inlet 149, compressed air regulator 148, and piston 142, respectively, in FIG. 1. Further, actuation system 310 may also include outlet 317 and outlet 319. Outlet 317 and outlet 319 may be an example of one implementation for number of outlets 151 in FIG. 1. In this illustrative example, power line 316 may be used to provide electrical power to fluid dispensing system 300. Of course, in other illustrative examples, fluid dispensing system 300 may be powered using pneumatic power and/or some other type of power.

In this illustrative example, exit 318 of nozzle 312 may be an example of one implementation for exit 150 in FIG. 1. Exit 318 may also be the exit of the chamber (not shown) that passes through housing 302 and nozzle 312. Nozzle screen 320 may be positioned at exit 318 such that fluid being dispensed through nozzle 312 passes through nozzle screen 320. Nozzle screen 320 may be an example of one implementation for nozzle screen 152 in FIG. 1.

Further, exit structure 322 may be attached to nozzle 312. Exit structure 322 may be an example of one implementation for exit structure 154 in FIG. 1. Exit structure 322 may be used to further control the flow of fluid out of nozzle 312.

Tool system 324 may be attached to housing 302 in this illustrative example. Tool system 324 may be an example of one implementation for tool system 156 in FIG. 1. Further, as depicted, air protection device 326 may be associated with tool system 324. Air protection device 326 may receive air through air line 328. Tool system 324 and air protection device 326 may be described in greater detail in FIG. 5 below.

In this illustrative example, fluid dispensing system 300 may also include drip tray hook 330. Drip tray hook 330 may be used to attach a drip tray (not shown) to fluid dispensing system 300. This drip tray may be used to catch any dripping of fluid that is dispensed from nozzle 312. In other examples, a drip bucket (not shown) may be hung from drip tray hook 330. Drip tray hook 330 may be an example of one implementation for attachment feature 164 in FIG. 1.

Figure 4:
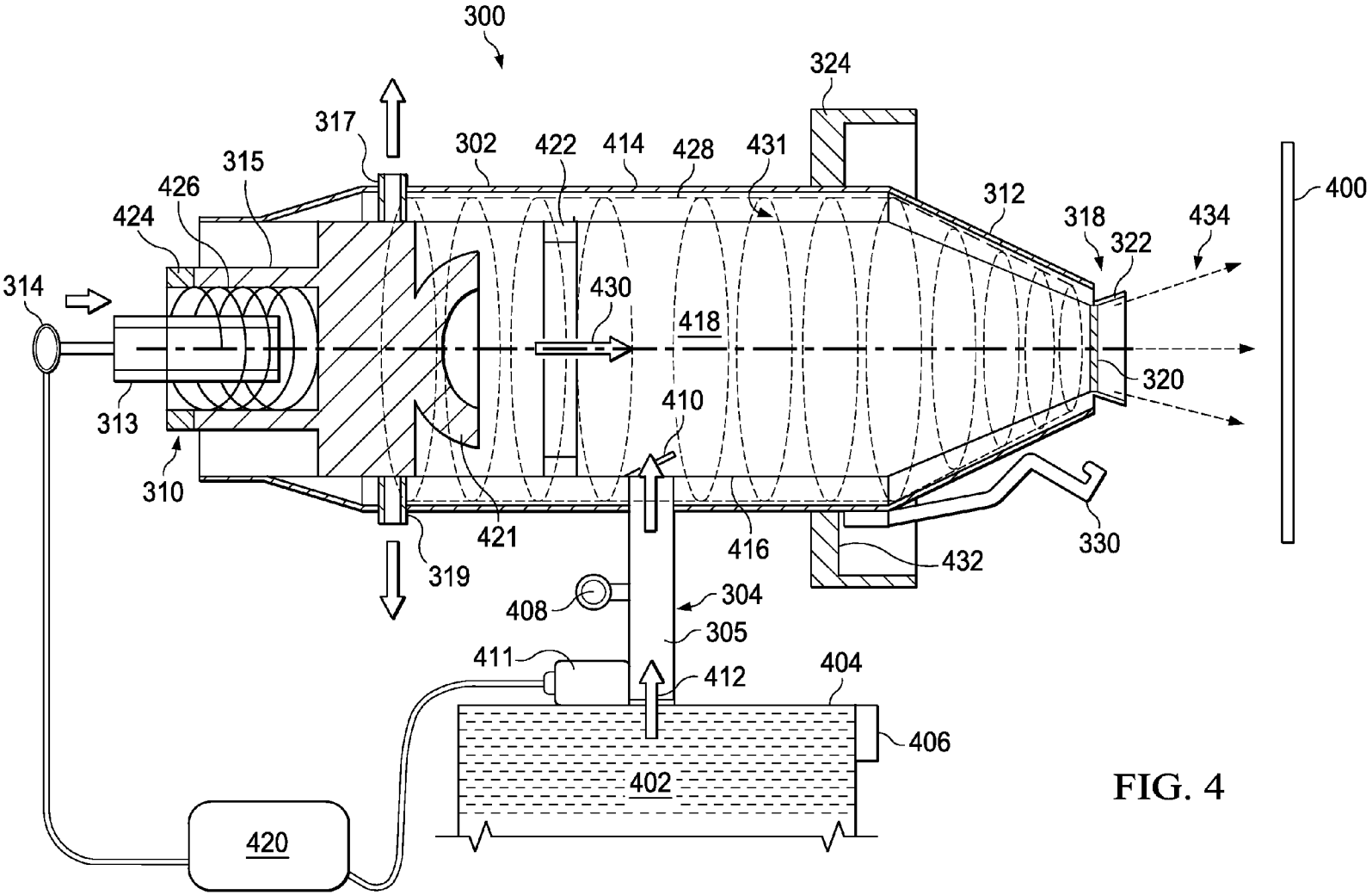
FIG. 4 is an illustration of a cross-sectional view of a fluid dispensing system in accordance with an illustrative embodiment.

Turning now to FIG. 4, an illustration of a cross-sectional view of fluid dispensing system 300 from FIG. 3 is depicted in accordance with an illustrative embodiment. In this illustrative example, a cross-sectional view of fluid dispensing system 300 has been taken with respect to lines 4-4 from FIG. 3.

As depicted, fluid dispensing system 300 may be used to dispense fluid 402 and apply fluid 402 held in fluid tank 404 onto surface 400. Fluid 402 and fluid tank 404 may be examples of implementations for fluid 104 and fluid source 132, respectively, in FIG. 1.

In this illustrative example, fluid tank 404 may be heated. In other words, fluid tank 404 may be configured to heat fluid 402 to reduce the viscosity of fluid 402 to a desired viscosity.

In some cases, fluid tank 404 may also be equipped with mixers (not shown) for use in mixing and preparing a multi-component fluid 402 before dispensing. In other words, fluid 402 may be comprised of a single homogeneous substance or a combination of various substances that are mixed within fluid tank 404. Thermometer 406 may be used to monitor the temperature of fluid 402 within fluid tank 404.

Fluid transfer system 304 may transfer fluid 402 from fluid tank 404 into chamber 418 within housing 302. Fluid transfer system 304 may include hose 305, viscometer 408, valve 410, and pump 411. Viscometer 408 and valve 410 may be examples of implementations for viscometer 136 and valve 138, respectively, in FIG. 1.

Viscometer 408 may be associated with hose 305 and configured to measure the viscosity of fluid 402. Valve 410 may be configured to control the flow of fluid 402 into chamber 418. Pump 411 may be used to pump fluid 402 from fluid tank 404 into hose 305 and towards valve 410. Fluid 402 may flow from fluid tank 404 into chamber 418 in the direction of arrow 412.

As depicted, housing 302 may have outer surface 414 and inner surface 416. Chamber 418 may be formed by inner surface 416 of housing 302. Outer surface 414, inner surface 416, and chamber 418 may be examples of implementations for outer surface 124, inner surface 126, and chamber 115, respectively, in FIG. 1.

In this illustrative example, actuation system 310 may include piston 315, stopper 422, stopper 424, spring 426, inlet 313, and compressed air regulator 314. Stopper 422 and stopper 424 may be an example of one implementation for plurality of stoppers 144 in FIG. 1.

Controller 420 may be used to control compressed air regulator 314, and thereby, the motion of piston 315 in synchronization with pump 411 to deliver fluid 402. Controller 420 may be an example of one implementation for controller 166 in FIG. 1. Compressed air regulator 314 may regulate the sending of compressed air into inlet 313 associated with piston 315. This compressed air may power piston 315 and cause piston 315 to move away from an initial position in the direction of arrow 430. Stopper 422 may limit the movement of piston 315 such that piston 315 may not be moved past stopper 422 in the direction of arrow 430.

The compressed air may be discharged through outlet 317 and outlet 319. When the compressed air is discharged, spring 426 may cause piston 315 to return to or near the initial position for piston 315. In this manner, spring 426 may be implemented using an extension spring in this illustrative example. Spring 426 may be an example of one implementation for spring 146 in FIG. 1.

Stopper 424 may be used to limit the movement of piston 315 in the direction opposite of arrow 430. Stopper 422 and stopper 424 may be implemented using ring stoppers, in this illustrative example.

In this manner, compressed air regulator 314 may be used to send compressed air into inlet 313 in a manner that causes piston 315 to move within chamber 418 in a pumping manner. Piston 315 may be used to pump fluid 402 out of chamber 418. As depicted, scooping structure 421 may be associated with piston 315. Scooping structure 421 may be used to cause fluid 402 to converge, or be scooped, within chamber 418 and move in the direction of arrow 430.

In this illustrative example, fluid dispensing system 300 may include heating system 428. Heating system 428 may comprise plurality of heating coils 431. Heating system 428 and plurality of heating coils 431 may be an example of implementations for heating system 118 and plurality of heating coils 140, respectively, in FIG. 1. As depicted, plurality of heating coils 431 may be located between inner surface 416 and outer surface 414 of housing 302. Plurality of heating coils 431 may be used to heat fluid 402 within chamber 418 to ensure that a desired viscosity for fluid 402 is maintained such that a desired mobility for fluid 402 is also maintained. In some cases, plurality of heating coils 431 may be controlled by controller 420, as in this illustrative example.

Further, inner surface 416 may be comprised of a friction-reducing material, such as, for example, without limitation, a polytetrafluoroethylene material, configured to reduce friction created between inner surface 416 and fluid 402 as fluid 402 moves within chamber 418.

As depicted, fluid 402 may be dispensed by being pushed out of nozzle 312 at exit 318 of chamber 418. Tool system 324 may have tool housing 432 configured to house a number of tools (not shown in this view). Tool housing 432 may be an example of one implementation for tool housing 160 in FIG. 1.

In this illustrative example, fluid 402 may exit nozzle 312 through nozzle screen 320 in the direction of arrows 434. The flow pattern of fluid 402 as fluid 402 is dispensed may be controlled by the shape of exit structure 322 and a plurality of holes (not shown) in nozzle screen 320. This plurality of holes (not shown) in nozzle screen 320 may be implemented in a manner similar to plurality of holes 206 in nozzle screen 152 in FIG. 2.

Controller 420 may be used to control the dispensing of fluid 402 from fluid dispensing system 300 such that the supply of fluid 402 from fluid tank 404 into chamber 418 and the spraying of fluid 402 out through nozzle screen 320 are synchronized. In some cases, controller 420 may be used to perform other operations. For example, without limitation, fluid dispensing system 300 may be operated by a robotic operator. Controller 420 may be used to control the robotic operator and/or communicate with the robotic operator.

Figure 5:
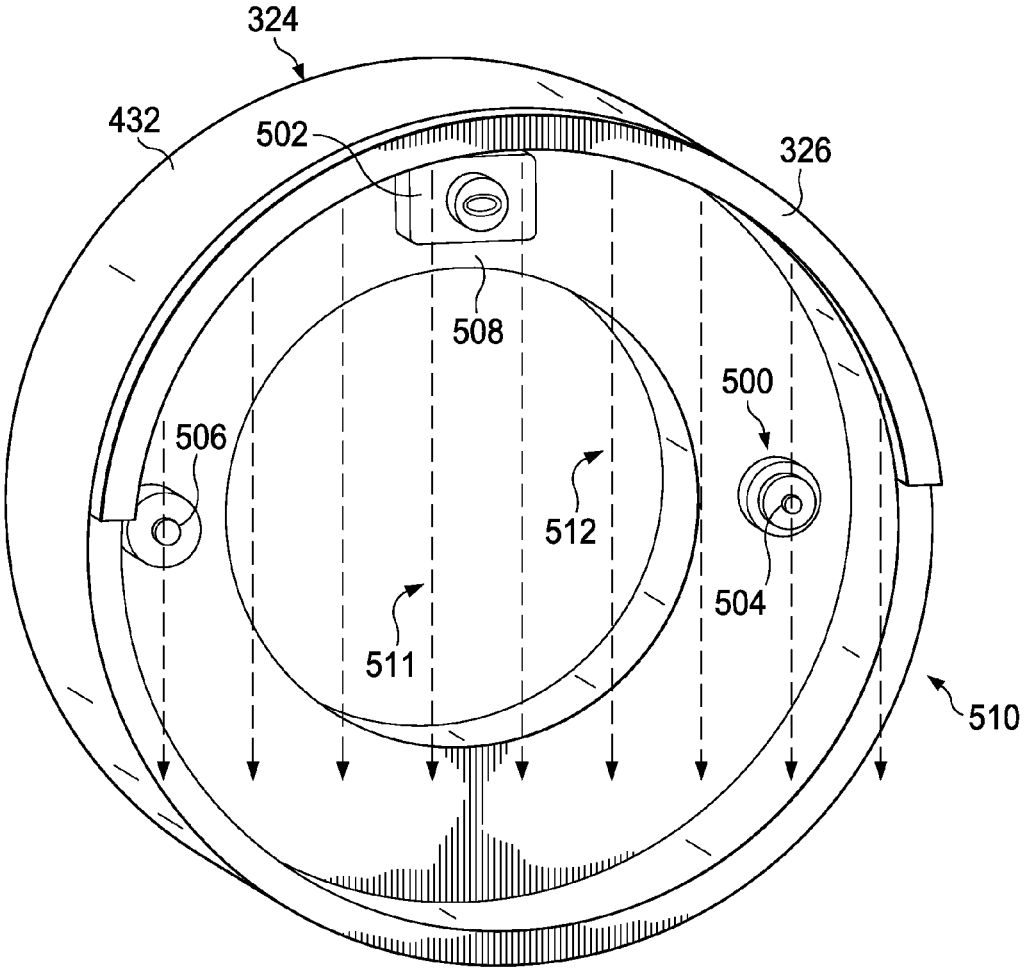
FIG. 5 is an illustration of a tool system and an air protection device in accordance with an illustrative embodiment.

With reference now to FIG. 5, an illustration of tool system 324 and air protection device 326 from FIGS. 3-4 is depicted in accordance with an illustrative embodiment. In this illustrative example, tool system 324 includes number of tools 500 housed within tool housing 432. Number of tools 500 may be an example of one implementation for number of tools 158 in FIG. 1.

As depicted, number of tools 500 may include camera 502, light source 504, and sensor 506. Camera 502, light source 504, and sensor 506 may be mounted to surface 508 of tool housing 432. Further, camera 502, light source 504, and sensor 506 may be exposed at side 510 of tool housing 432. Camera 502 may be used to monitor the dispensing of fluid 402 through nozzle screen 320 in FIG. 4. Light source 504 may provide light when needed. Sensor 506 may be used to measure the thickness of fluid 402 from FIG. 4 being dispensed through nozzle screen 320.

As depicted, air protection device 326 may be configured to allow air received through air line 328 in FIG. 3 to flow through holes or slits (not shown) in air protection device 326 in the direction of arrows 511. Air may flow in the direction of arrows 511 at a rate and in a manner such that air curtain 512 is created. Air curtain 512 may shield number of tools 500 from any fluid spatter resulting from the dispensing of fluid 402 in FIG. 4 and/or from the elements in the environment around fluid dispensing system 300.

Figure 6:
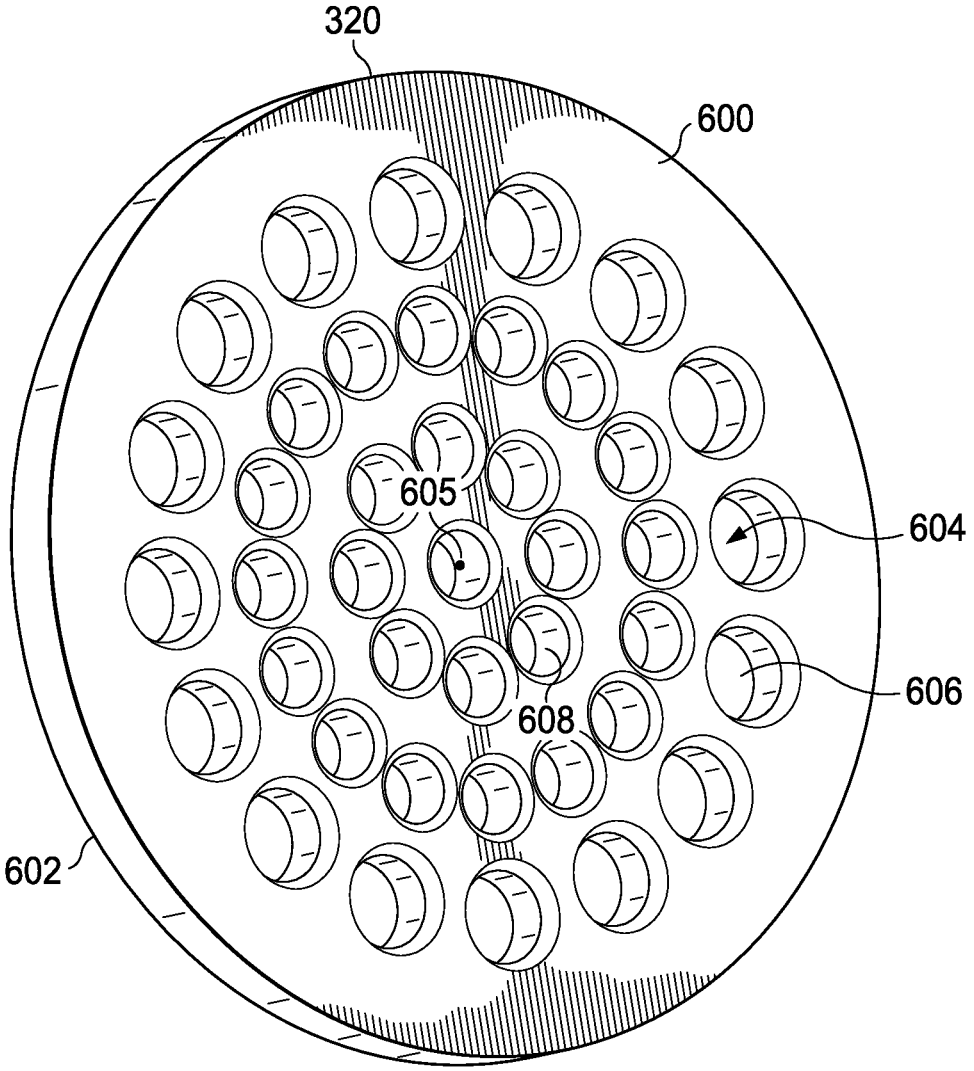
FIG. 6 is another illustration of a nozzle screen in accordance with an illustrative embodiment.

With reference now to FIG. 6, an illustration of nozzle screen 320 from FIGS. 3-4 is depicted in accordance with an illustrative embodiment. As depicted, nozzle screen 320 has first side 600 and second side 602. First side 600 and second side 602 may be examples of implementations for first side 202 and second side 204, respectively, in FIG. 2. Fluid 402 may be configured to enter nozzle screen 320 through first side 600 and exit nozzle screen 320 through second side 602.

In this illustrative example, nozzle screen 320 has plurality of holes 604 with different sizes. Plurality of holes 604 may be an example of one implementation for plurality of holes 206 in FIG. 2. Plurality of holes 604 may be sized such that the flow rate of fluid 402 through each of plurality of holes 604 is substantially constant. Typically, the flow rate of fluid 402 increases towards center 605 and decreases away from center 605. Further, flow rate may be substantially equal to the area of a hole multiplied by the velocity of fluid 402 flowing through that hole.

Consequently, the holes in plurality of holes 604 may be sized such that holes in plurality of holes 604 at or near center 605 of nozzle screen 320 have a smaller diameter than other holes at or near a periphery of nozzle screen 320 to ensure a substantially constant flow rate through each of plurality of holes 604. For example, without limitation, hole 606, which is further away from center 605 than hole 608, may be larger in size than hole 608. In this manner, fluid 402 may be dispensed in a desired manner with a desired level of accuracy.

Further, each of plurality of holes 604 may have a tapered shape configured to pressurize fluid 402 from FIG. 4 as fluid 402 passes through nozzle screen 320. In particular, each of plurality of holes 604 may have a larger diameter at first side 600 as compared to second side 602. In this manner, fluid 402 may be pressurized as fluid 402 passes through nozzle screen 320. Plurality of holes 604 may function as a plurality of small nozzles working in parallel.

Figure 7:
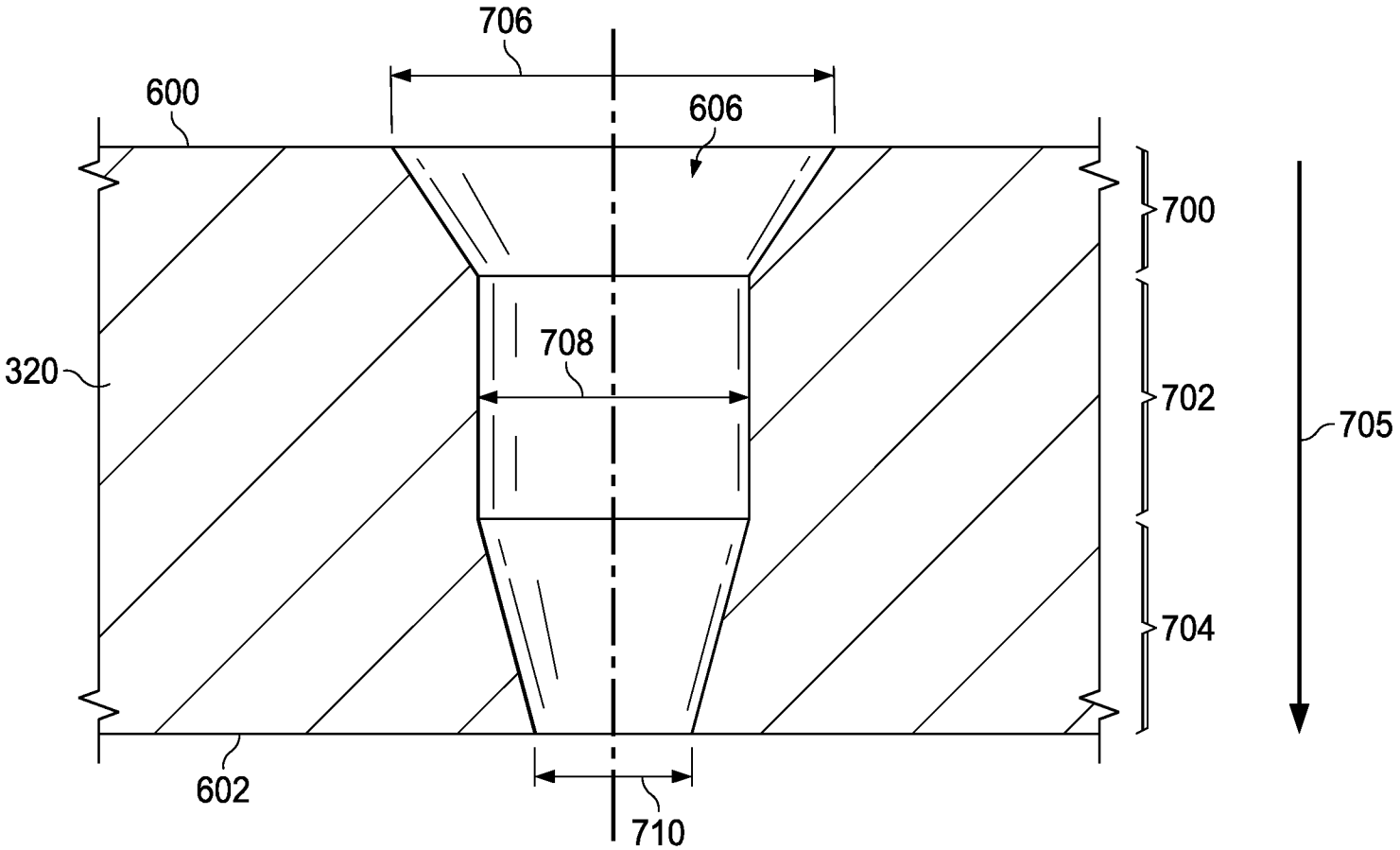
FIG. 7 is an illustration of a hole in accordance with an illustrative embodiment.

With reference now to FIG. 7, an illustration of hole 606 from FIG. 6 is depicted in accordance with an illustrative embodiment. In this illustrative example, hole 606 has first portion 700, second portion 702, and third portion 704. First portion 700 is located closer to first side 600 of nozzle screen 320 and third portion 704 is located closer to second side 602 of nozzle screen 320.

As depicted, within first portion 700 of hole 606, the diameter of hole 606 decreases in size in the direction of arrow 705 from diameter 706 to diameter 708. Within second portion 702 of hole 606, the diameter of hole 606 remains substantially constant as diameter 708. Further, within third portion 704 of hole 606, the diameter of hole 606 further decreases in size in the direction of arrow 705 from diameter 708 to diameter 710.

Fluid 402 from FIG. 4 may pass through nozzle screen 320 in the direction of arrow 705. As fluid 402 passes through hole 606, the tapered shape of hole 606, in particular the decrease in the diameter of hole 606 in the direction of arrow 705, causes the exit pressure of fluid 402 passing through hole 606 to be increased. This increase in exit pressure may cause fluid 402 to exit hole 606 at an increased velocity such that fluid 402 may reach a further distance.

Figure 8:
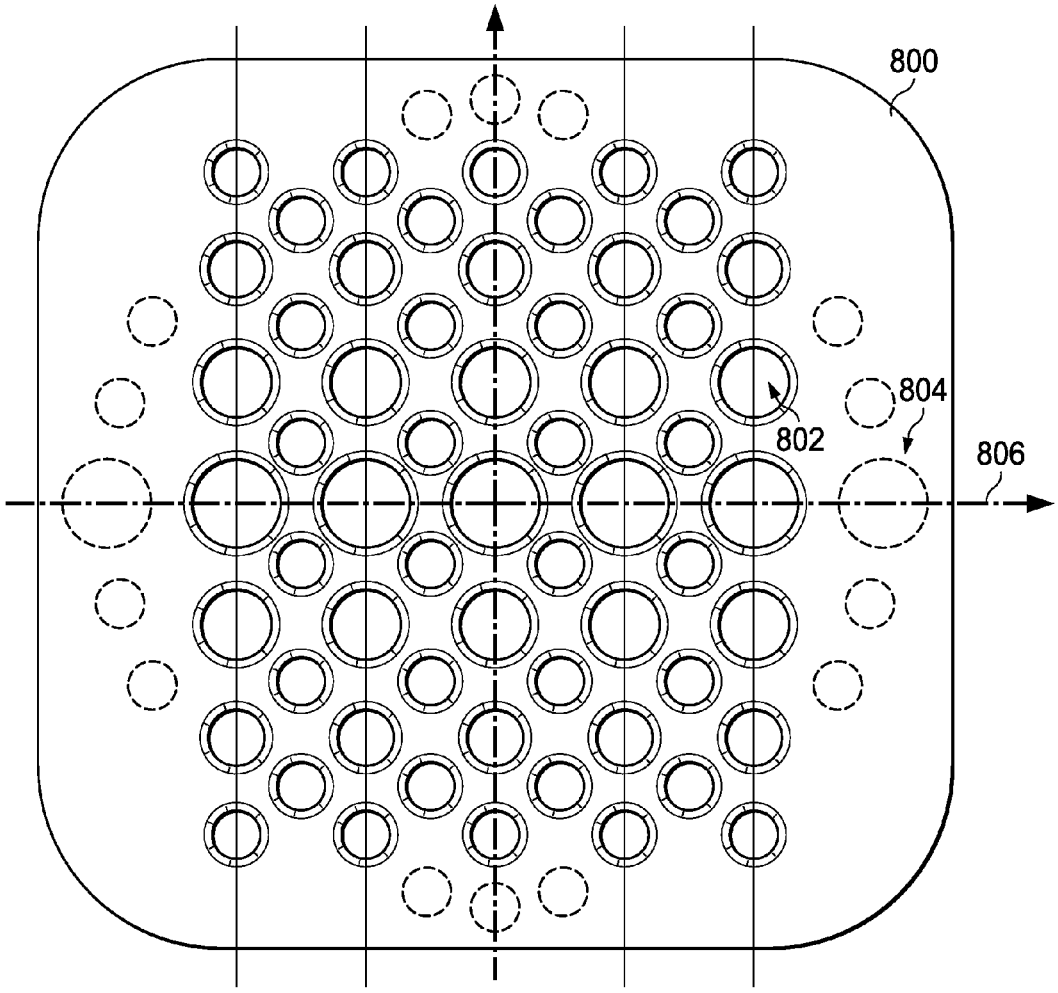
FIG. 8 is yet another illustration of a nozzle screen in accordance with an illustrative embodiment.

With reference now to FIG. 8, an illustration of a nozzle screen is depicted in accordance with an illustrative embodiment. In this illustrative example, nozzle screen 800 may be an example of another implementation for nozzle screen 152 in FIG. 1. Nozzle screen 800 may have plurality of holes 802 arranged in pattern 804. Plurality of holes 802 may be another example of one implementation for plurality of holes 206 in FIG. 2.

In this illustrative example, the portion of plurality of holes 802 aligned with axis 806 may be larger than the other holes in plurality of holes 802. Further, each of plurality of holes 802 may have a tapered shape configured such that any fluid passing through nozzle screen 800 may be pressurized.

The illustrations of fluid dispensing system 300 in FIGS. 3-4, tool system 324 in FIG. 5, nozzle screen 320 in FIG. 6, hole 606 in FIG. 7, and nozzle screen 800 in FIG. 8 are not meant to imply physical or architectural limitations to the manner in which an illustrative embodiment may be implemented. Other components in addition to or in place of the ones illustrated may be used. Some components may be optional.

The different components shown in FIGS. 3-8 may be illustrative examples of how components shown in block form in FIGS. 1-2 can be implemented as physical structures. Additionally, some of the components in FIGS. 3-8 may be combined with components in FIGS. 1-2, used with components in FIGS. 1-2, or a combination of the two.

Figure 9:
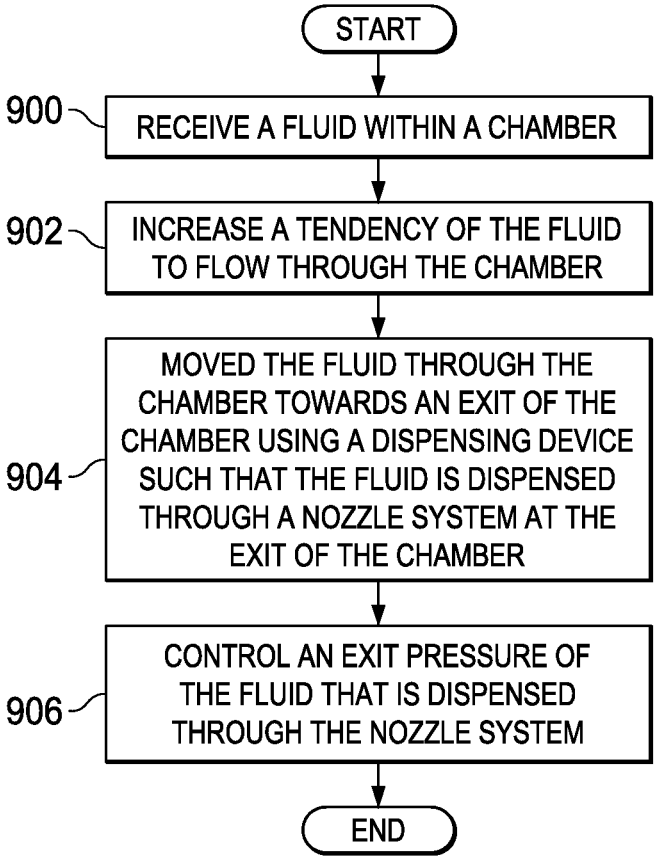
FIG. 9 is an illustration of a process for dispensing fluid in the form of a flowchart in accordance with an illustrative embodiment.

With reference now to FIG. 9, an illustration of a process for dispensing fluid is depicted in the form of a flowchart in accordance with an illustrative embodiment. The process illustrated in FIG. 9 may be implemented using fluid dispensing system 102 in FIG. 1.

The process may begin by receiving fluid 104 within chamber 115 formed by inner surface 126 of housing 114 (operation 900). Further, inner surface 126 may be comprised of friction-reducing material 128. Next, a tendency of fluid 104 to flow through chamber 115 may be increased (operation 902).

Thereafter, fluid 104 may be moved through chamber 115 towards exit 150 of chamber 115 using dispensing device 120 such that fluid 104 is dispensed out of chamber 115 through nozzle system 121 at exit 150 of chamber 115 (operation 904). The exit pressure of fluid 104 dispensed through nozzle system 121 may be controlled (operation 906), with the process terminating thereafter. In particular, nozzle system 121 may include nozzle 122 and nozzle screen 152 in which at least one of nozzle 122 and nozzle screen 152 may be used to control the exit pressure of fluid 104 such that fluid 104 exits nozzle system 121 at the desired velocity.

Figure 10:
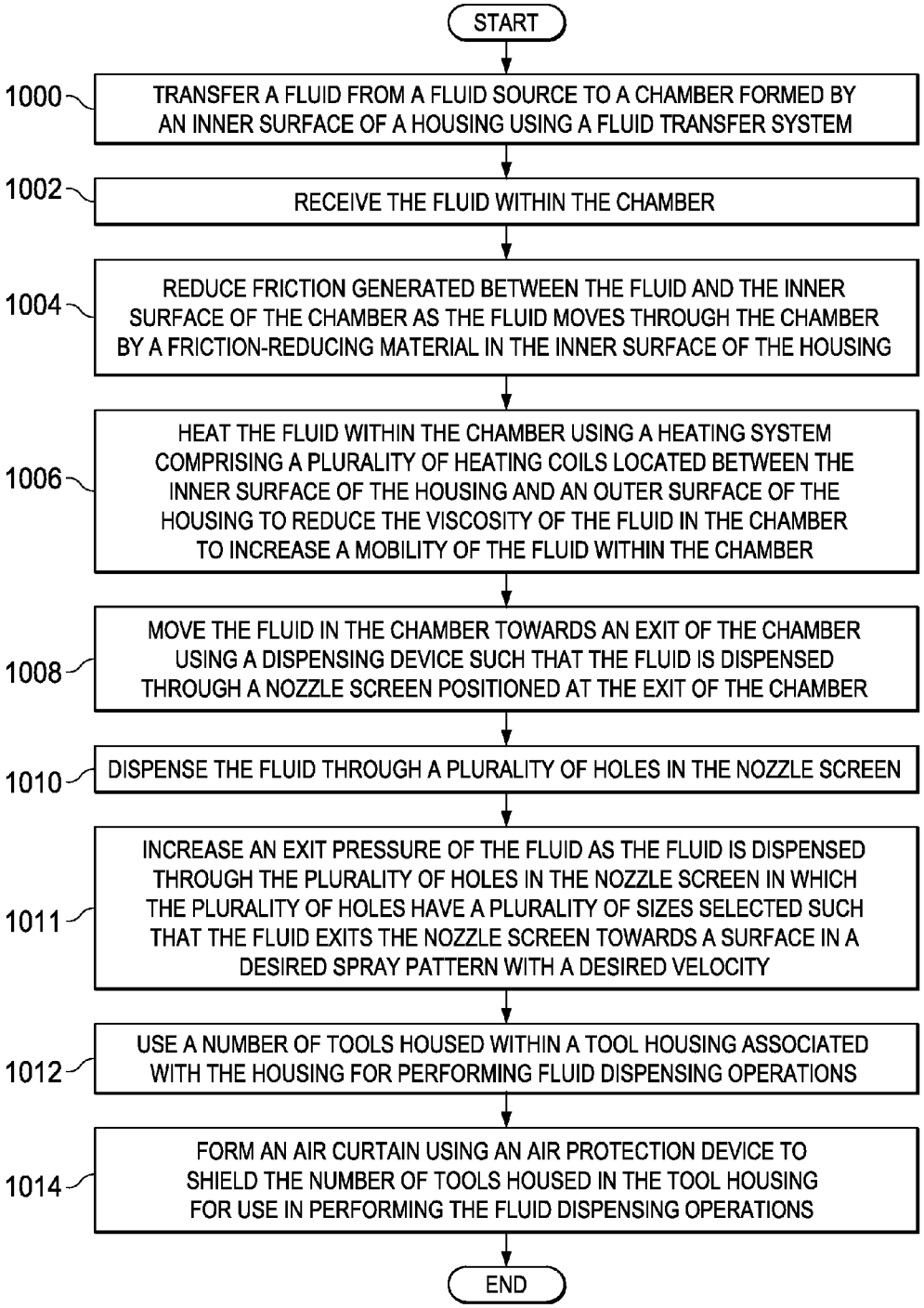
FIG. 10 is an illustration of a process for dispensing fluid in the form of a flowchart in accordance with an illustrative embodiment.

With reference now to FIG. 10, an illustration of a process for dispensing fluid is depicted in the form of a flowchart in accordance with an illustrative embodiment. The process in FIG. 10 may be implemented using fluid dispensing system 102 in FIG. 1.

The process may begin by transferring fluid 104 from fluid source 132 to chamber 115 formed by inner surface 126 of housing 114 using fluid transfer system 116 (operation 1000). Fluid 104 may be received within chamber 115 (operation 1002). Inner surface 126 may be comprised of friction-reducing material 128. In one illustrative example, friction-reducing material 128 may take the form of polytetrafluoroethylene 130.

Further, friction generated between fluid 104 and inner surface 126 of chamber 115 as fluid 104 moves through chamber 115 may be reduced by friction-reducing material 128 in inner surface 126 of housing 114 (operation 1004). Fluid 104 within chamber 115 may be heated using heating system 118 comprising plurality of heating coils 140 located between inner surface 126 of housing 114 and outer surface 124 of housing 114 to reduce viscosity 110 of fluid 104 in chamber 115 to increase a mobility of fluid 104 within chamber 115 (operation 1006).

Fluid 104 in chamber 115 may be moved towards exit 150 of chamber 115 using dispensing device 120 such that fluid 104 is dispensed through nozzle screen 152 positioned at exit 150 of chamber 115 (operation 1008). Fluid 104 may be dispensed through plurality of holes 206 in nozzle screen 152 (operation 1010). Further, an exit pressure of fluid 104 may be increased as fluid 104 is dispensed through plurality of holes 206 in nozzle screen 152 in which plurality of holes 206 have plurality of sizes 207 selected such that fluid 104 exits nozzle screen 152 towards surface 106 in a desired spray pattern with a desired velocity (operation 1011).

Number of tools 158 housed within tool housing 160 associated with housing 114 may be used for performing fluid dispensing operations (operation 1012). An air curtain may be formed using air protection device 162 to shield number of tools 158 housed in tool housing 160 for use in performing fluid dispensing operations (operation 1014), with the process terminating thereafter. In particular, in operation 1014, the air curtain formed by air protection device 162 may be used to shield number of tools 158 from fluid spatter and/or other types of debris.

Figure 11:
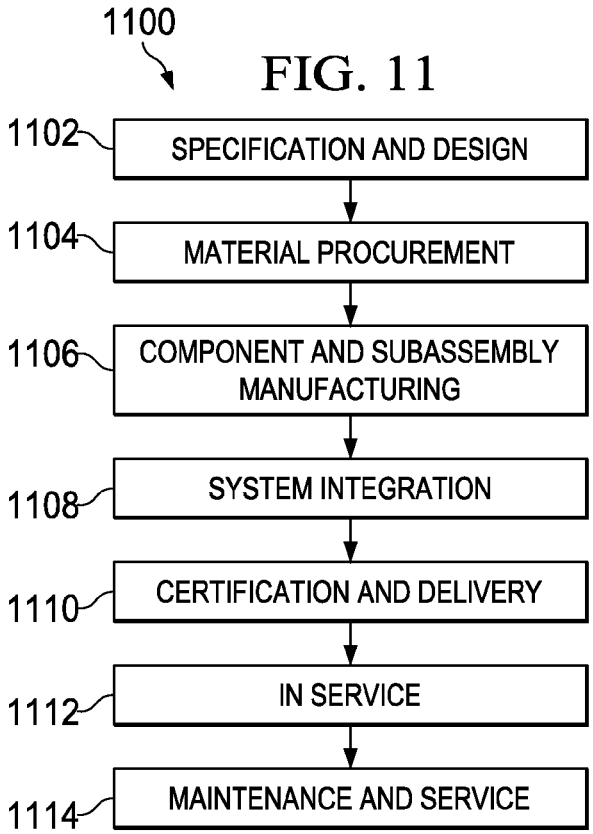
FIG. 11 is an illustration of an aircraft manufacturing and service method in the form of a flowchart in accordance with an illustrative embodiment.
Figure 12:
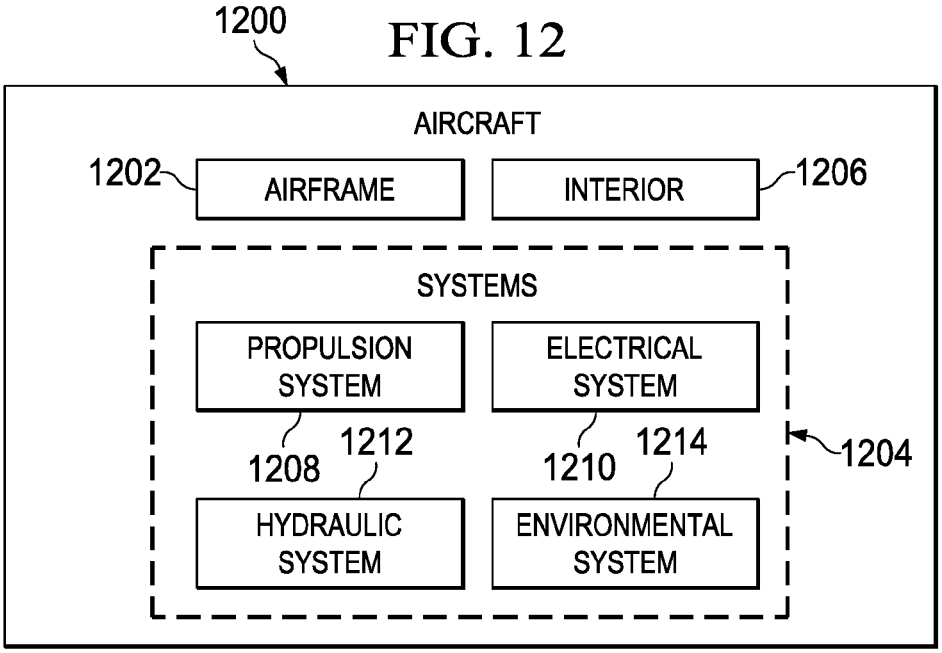
FIG. 12 is an illustration of an aircraft in the form of a block diagram in which an illustrative embodiment may be implemented.

Illustrative embodiments of the disclosure may be described in the context of aircraft manufacturing and service method 1100 as shown in FIG. 11 and aircraft 1200 as shown in FIG. 12. Turning first to FIG. 11, an illustration of an aircraft manufacturing and service method is depicted in the form of a flowchart in accordance with an illustrative embodiment. During pre-production, aircraft manufacturing and service method 1100 may include specification and design 1102 of aircraft 1200 in FIG. 12 and material procurement 1104.

During production, component and subassembly manufacturing 1106 and system integration 1108 of aircraft 1200 in FIG. 12 takes place. Thereafter, aircraft 1200 in FIG. 12 may go through certification and delivery 1110 in order to be placed in service 1112. While in service 1112 by a customer, aircraft 1200 in FIG. 12 is scheduled for routine maintenance and service 1114, which may include modification, reconfiguration, refurbishment, and other maintenance or service.

Each of the processes of aircraft manufacturing and service method 1100 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of vendors, subcontractors, and suppliers; and an operator may be an airline, a leasing company, a military entity, a service organization, and so on.

With reference now to FIG. 12, an illustration of an aircraft is depicted in the form of a block diagram in which an illustrative embodiment may be implemented. In this example, aircraft 1200 is produced by aircraft manufacturing and service method 1100 in FIG. 11 and may include airframe 1202 with plurality of systems 1204 and interior 1206. Examples of systems 1204 include one or more of propulsion system 1208, electrical system 1210, hydraulic system 1212, and environmental system 1214. Any number of other systems may be included. Although an aerospace example is shown, different illustrative embodiments may be applied to other industries, such as the automotive industry.

Apparatuses and methods embodied herein may be employed during at least one of the stages of aircraft manufacturing and service method 1100 in FIG. 11. In particular, fluid dispensing system 102 from FIG. 1 may be used for applying fluid 104, such as sealant 105, to one or more objects of aircraft 1200 during any one of the stages of aircraft manufacturing and service method 1100. For example, without limitation, fluid dispensing system 102 from FIG. 1 may be used to dispense and apply sealant 105 in FIG. 1 during at least one of component and subassembly manufacturing 1106, system integration 1108, routine maintenance and service 1114, or some other stage of aircraft manufacturing and service method 1100.

In one illustrative example, components or subassemblies produced in component and subassembly manufacturing 1106 in FIG. 11 may be fabricated or manufactured in a manner similar to components or subassemblies produced while aircraft 1200 is in service 1112 in FIG. 11. As yet another example, one or more apparatus embodiments, method embodiments, or a combination thereof may be utilized during production stages, such as component and subassembly manufacturing 1106 and system integration 1108 in FIG. 11. One or more apparatus embodiments, method embodiments, or a combination thereof may be utilized while aircraft 1200 is in service 1112 and/or during maintenance and service 1114 in FIG. 11. The use of a number of the different illustrative embodiments may substantially expedite the assembly of and/or reduce the cost of aircraft 1200.

The flowcharts and block diagrams in the different depicted embodiments illustrate the architecture, functionality, and operation of some possible implementations of apparatuses and methods in an illustrative embodiment. In this regard, each block in the flowcharts or block diagrams may represent a module, a segment, a function, and/or a portion of an operation or step.

In some alternative implementations of an illustrative embodiment, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other desirable embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

a housing comprising:

a chamber configured to receive a fluid in which the housing is configured to increase a tendency of the fluid to flow within the chamber; and a heating system configured to heat the fluid within the chamber to reduce a viscosity of the fluid in the chamber such that the tendency of the fluid to flow within the chamber is increased;

a dispensing device configured to move the fluid in the chamber towards an exit of the chamber such that the fluid is dispensed through the exit of the chamber; and a nozzle system configured to control an exit pressure of the fluid that is dispensed through the nozzle system.

2. The apparatus of claim 1, wherein the nozzle system comprises:

a nozzle; and a nozzle screen positioned at the exit of the chamber in which at least one of the nozzle and the nozzle screen is configured to control the exit pressure of the fluid being dispensed through the nozzle system.

3. The apparatus of claim 2, wherein the nozzle screen comprises:

a plurality of holes having a plurality of sizes selected to control the exit pressure of the fluid across the nozzle screen.

4. The apparatus of claim 3, wherein each of the plurality of holes has a tapered shape configured such that the fluid exits the nozzle screen towards a surface in a desired spray pattern with a desired velocity.

5. The apparatus of claim 4, wherein the tapered shape of a hole in the plurality of holes is formed by the hole having a first diameter at a first side of the nozzle screen that is larger than a second diameter of the hole at a second side of the nozzle screen and wherein the fluid is configured to pass through the hole from the first side to the second side.

6. The apparatus of claim 3, wherein holes in the plurality of holes at a center of the nozzle screen have a smaller diameter than other holes near a periphery of the nozzle screen such that the fluid exiting the nozzle screen has a substantially constant flow rate across the nozzle screen.

7. The apparatus of claim 1, wherein the heating system comprises a plurality of heating coils located between an inner surface of the housing and an outer surface of the housing.

8. The apparatus of claim 1, wherein the housing further comprises:

an inner surface configured to form the chamber; and an outer surface.

9. The apparatus of claim 8, wherein the inner surface is comprised of a friction-reducing material configured to reduce friction generated between the fluid and the inner surface as the fluid moves through the chamber such that tendency of the fluid to flow within the chamber is increased.

10. The apparatus of claim 9, wherein the friction-reducing material is selected from one of polytetrafluoroethylene, a nanostructured non-stick material, and a nanostructured ceramic material.

11. The apparatus of claim 1, wherein the dispensing device comprises:

an actuation system configured to move the fluid in the chamber towards the exit of the chamber.

12. The apparatus of claim 11, wherein the actuation system comprises:

a piston configured to move within the chamber; and a plurality of stoppers, wherein the plurality of stoppers is configured to limit movement of the piston within the chamber.

13. The apparatus of claim 1 further comprising:

a fluid transfer system configured to transfer the fluid from a fluid source to the chamber.

14. The apparatus of claim 13, wherein the fluid transfer system comprises:

a number of transfer elements configured to allow the fluid to flow from the fluid source to the chamber;

a viscometer configured to measure a viscosity of the fluid being transferred from the fluid source to the chamber; and a valve configured to control a flow of the fluid into the chamber.

15. The apparatus of claim 1 further comprising:

a tool system associated with the housing and configured to hold a number of tools for use in performing fluid dispensing operations; and an air protection device associated with the tool system and configured to shield the number of tools from fluid spatter.

16. The apparatus of claim 1 further comprising:

an attachment feature configured for association with the housing and configured for use in attaching one of a drip tray and a drip bucket to catch any dripping of the fluid as the fluid exits the chamber.

17. The apparatus of claim 1 further comprising:

a controller configured to control a heating system and the dispensing device.

18. The apparatus of claim 1 further comprising:

a fluid source configured to hold the fluid, wherein the fluid is transferred from the fluid source to the chamber.

19. The apparatus of claim 18, wherein the fluid source comprises:

a heating device configured to heat the fluid, while the fluid is held within the fluid source, to a temperature selected based on a viscosity of the fluid.

20. A fluid dispensing system comprising:

a housing comprising:

an outer surface;

an inner surface configured to form a chamber in which the inner surface is comprised of a friction-reducing material selected from one of polytetrafluoroethylene, a nanostructured non-stick material, and a nanostructured ceramic material in which the friction-reducing material is configured to reduce friction generated between the fluid and the inner surface such that a tendency of the fluid to flow through the chamber is increased; and a heating system configured to heat the fluid within the chamber to reduce a viscosity of the fluid in the chamber such that the tendency of the fluid to flow through the chamber is increased in which the heating system comprises a plurality of heating coils located between the inner surface of the housing and the outer surface of the housing;

a dispensing device configured to move the fluid in the chamber towards an exit of the chamber such that the fluid is dispensed through the exit of the chamber in which the fluid dispensing system comprises a piston configured to move within the chamber and a plurality of stoppers in which at least one of the plurality of stoppers is configured to limit movement of the piston within the chamber;

a nozzle system comprising:

a nozzle; and a nozzle screen positioned at the exit of the chamber in which the nozzle screen comprises a plurality of holes having a plurality of sizes selected to control an exit pressure of the fluid across the nozzle screen as the fluid exits the nozzle screen such that the fluid is dispensed towards a surface in a desired spray pattern with a desired velocity and in which each of the plurality of holes has a tapered shape;

a fluid transfer system configured to transfer the fluid from a fluid source to the chamber;

a tool system associated with the housing and configured to hold a number of tools for use in performing fluid dispensing operations;

an air protection device associated with the tool system and configured to shield the number of tools from fluid spatter;

an attachment feature configured for association with the housing and configured for use in attaching one of a drip tray and a drip bucket to the housing to catch any dripping of the fluid as the fluid exits the chamber; and a controller configured to control the heating system and the dispensing device.

21. A method for dispensing a fluid, the method comprising:

receiving the fluid within a chamber formed by an inner surface of a housing;

increasing a tendency of the fluid to flow through the chamber, wherein increasing the tendency of the fluid to flow through the chamber comprises heating the fluid within the chamber using a heating system to reduce a viscosity of the fluid in the chamber such that the tendency of the fluid to flow through the chamber is increased;

moving the fluid through the chamber towards an exit of the chamber using a dispensing device such that the fluid is dispensed through a nozzle system at the exit of the chamber; and controlling an exit pressure of the fluid that is dispensed through the nozzle system.

22. The method of claim 21, wherein controlling the exit pressure of the fluid dispensed through the exit of the chamber comprises:

controlling the exit pressure of the fluid dispensed through the exit of the chamber using a nozzle screen in the nozzle system positioned at the exit of the chamber.

23. The method of claim 22, wherein controlling the exit pressure of the fluid dispensed through the exit of the chamber using the nozzle screen comprises:

controlling the exit pressure of the fluid dispensed through the exit of the chamber using a plurality of holes in the nozzle screen having a plurality of sizes selected to control the exit pressure of the fluid across the nozzle screen.

24. The method of claim 23, wherein controlling the exit pressure of the fluid dispensed through the exit of the chamber using the plurality of holes in the nozzle screen comprises:

increasing the exit pressure of the fluid dispensed through the exit of the chamber using the plurality of holes in the nozzle screen such that the fluid exits the nozzle screen towards a surface in a desired spray pattern with a desired velocity.

25. The method of claim 23, wherein moving the fluid in the chamber towards the exit of the chamber using the dispensing device such that the fluid is dispensed through the nozzle system at the exit of the chamber further comprises:

dispensing the fluid through the plurality of holes in the nozzle screen.

26. The method of claim 21, wherein increasing the tendency of the fluid to flow through the chamber comprises:

reducing, by a friction-reducing material forming the inner surface of the housing, friction generated between the fluid and the inner surface of the housing as the fluid moves through the chamber such that the tendency of the fluid to flow through the chamber is increased, wherein the friction-reducing material is selected from one of polytetrafluoroethylene, a nanostructured non-stick material, and a nanostructured ceramic material.

27. The method of claim 21, wherein heating the fluid within the chamber comprises:

heating the fluid within the chamber using the heating system comprising a plurality of heating coils located between the inner surface of the housing and an outer surface of the housing.

28. The method of claim 21 further comprising:

transferring the fluid from a fluid source to the chamber using a fluid transfer system.

29. The method of claim 21, wherein moving the fluid in the chamber towards the exit of the chamber using the dispensing device such that the fluid is dispensed through the chamber comprises:

moving the fluid in the chamber towards the exit of the chamber using the dispensing device such that the fluid is dispensed through a nozzle screen positioned at the exit of the chamber.

30. The method of claim 21 further comprising:

shielding a number of tools housed in a tool housing associated with the housing for use in performing fluid dispensing operations using an air protection device.

31. A method for dispensing a fluid, the method comprising:

transferring the fluid from a fluid source to a chamber using a fluid transfer system;

receiving the fluid within the chamber in which the chamber is formed by an inner surface of a housing in which the inner surface is comprised of a friction-reducing material selected from one of polytetrafluoroethylene, a nanostructured non-stick material, and a nanostructured ceramic material;

reducing, by the friction-reducing material, friction generated between the fluid and the inner surface of the chamber as the fluid moves through the chamber such that a tendency of the fluid to flow through the chamber is increased;

heating the fluid within the chamber using a heating system comprising a plurality of heating coils located between the inner surface of the housing and an outer surface of the housing to reduce a viscosity of the fluid in the chamber such that tendency of the fluid to flow through the chamber is increased;

moving the fluid in the chamber towards an exit of the chamber using a dispensing device such that the fluid is dispensed through a nozzle screen positioned at the exit of the chamber;

dispensing the fluid through a plurality of holes in the nozzle screen towards a surface;

controlling an exit pressure of the fluid across the nozzle screen as the fluid is dispensed through the plurality of holes in the nozzle screen in which the plurality of holes have a plurality of sizes selected such that the fluid exits the nozzle screen towards the surface in a desired spray pattern with a desired velocity; and shielding a number of tools housed in a tool housing associated with the housing for use in performing fluid dispensing operations using an air protection device.

* * * * *